US005497584A

United States Patent [19]

Bergmann

[11] Patent Number: 5,497,584

[45] Date of Patent: Mar. 12, 1996

[54] PLASTER PROTECTIVE COVER FOR FLUSH MOUNTED BATHROOM FITTINGS

[75] Inventor: Konrad Bergmann, Wittlich, Germany

[73] Assignee: Ideal-Standard GmbH, Bonn, Germany

[21] Appl. No.: 175,408

[22] PCT Filed: Jun. 13, 1992

[86] PCT No.: PCT/EP92/01336

§ 371 Date: Feb. 15, 1994

§ 102(e) Date: Feb. 15, 1994

[87] PCT Pub. No.: WO93/01367

PCT Pub. Date: Jan. 21, 1993

[30] Foreign Application Priority Data

Jul. 5, 1991 [AT] Austria ..... 1356/91
Oct. 8, 1991 [DE] Germany ..... 41 33 266.0

[51] Int. Cl.[6] ..... E03C 1/042

[52] U.S. Cl. ..... 52/34; 52/DIG. 12; 4/675; 4/695; 4/696; 137/359; 137/360; 137/382; 285/23; 285/46; 285/64; 285/193

[58] Field of Search ..... 52/34, 35, DIG. 12; 285/23, 46, 64, 192, 193; 4/695, 696, 612, 614, 675, 676, 677, 678, DIG. 7; 137/360, 359, 382

[56] References Cited

U.S. PATENT DOCUMENTS

| | | | |
|---|---|---|---|
| 1,143,946 | 6/1915 | Covert | 137/360 |
| 2,318,857 | 5/1943 | Hollaender | 52/35 |
| 3,035,276 | 5/1962 | Hanson | 4/695 |
| 3,331,386 | 7/1967 | Politz | 137/359 |
| 3,419,288 | 12/1968 | Logsdon | 285/193 X |
| 3,495,616 | 2/1970 | Esposito | 4/696 X |
| 4,385,777 | 5/1983 | Logsdon | 285/46 X |
| 4,827,539 | 5/1989 | Kiziah | 4/DIG. 7 X |
| 4,896,381 | 1/1990 | Hutto | 4/695 |
| 5,031,658 | 7/1991 | Brattoli | 4/695 X |
| 5,277,220 | 1/1994 | Thul | 4/DIG. 7 X |
| 5,277,454 | 1/1994 | Lorch et al. | 285/192 X |

FOREIGN PATENT DOCUMENTS

| | | | |
|---|---|---|---|
| 313488 | 4/1989 | European Pat. Off. | 4/696 |
| 3237419 | 4/1984 | Germany | 4/DIG. 7 |
| 3237418 | 4/1984 | Germany | 4/DIG. 7 |
| 3626965 | 2/1988 | Germany | 4/DIG. 7 |
| 3634738 | 4/1988 | Germany | 4/DIG. 7 |
| 4121835 | 1/1993 | Germany | 4/677 |
| 6-10383 | 1/1994 | Japan | 4/695 |
| 2230062 | 10/1990 | United Kingdom . | |
| 8404795 | 12/1984 | WIPO | 285/64 |

*Primary Examiner*—Carl D. Friedman
*Assistant Examiner*—Laura A. Saladino
*Attorney, Agent, or Firm*—Herbert Dubno

[57] ABSTRACT

A plaster-protective cover for bathroom fittings is mounted recessed in the wall, the cover being fixed to the buried part of the fitting and having an outwards-facing dome-shaped cap designed to protect the fitting parts inside it. The hole in the wall for the fitting is sealed by a collar-like sealing element which produces a watertight seal and which has, at the wall end, an annular flange which rests against the wall. The flange is embedded in a layer of sealing material applied following installation of the buried part of the fitting as the bed layer for subsequently laid tiling, and the flange thus seals off the edge of the hole pierced in the wall for the buried part of the fitting.

6 Claims, 6 Drawing Sheets

PLASTER PROTECTIVE COVER FOR FLUSH MOUNTED BATHROOM FITTINGS

CROSS REFERENCE TO RELATED APPLICATIONS

This application is a national phase of PCT/EP92/01336 filed 13 Jun. 1992 and based upon German national application P41 33 266.0 of 8 Oct. 1991 under the International Convention.

FIELD OF THE INVENTION

My present invention relates to a plaster protective cover for a bathroom fitting, e.g. subplaster faucet or fitting; to be built in, whereby the plaster protective cover is fastenable on the subplaster body of the fitting for building in of the fitting and, for the protective covering of the inwardly lying fitting parts, has an outwardly extending hood or facing hood shaped [dome shaped] protective part.

BACKGROUND OF THE INVENTION

In rooms having sanitary fixtures, the room walls, for example in regions of bathtubs, shower stalls or the like, must be sealed absolutely tight which means that, before the application of tile to the wall, a watertight layer must be coated onto it as a base for the tiling. This sealing layer, however, is interrupted at the locations at which any buried fitting projects outwardly so that, in these regions, moisture can penetrate into the wall.

OBJECT OF THE INVENTION

The object of the invention is to provide an improved plaster protective cover, wherein the penetration location of the buried body of the fitting is sealed, so that the protective cover is functionally reliable, easily fabricated, satisfactory in use and cost effective.

SUMMARY OF THE INVENTION

To achieve this object the invention provides that the plaster protective cover is surrounded by a water tight, collar like sealing element which, on the wall side, has a circumferential annular flange lying against the wall and which is embedded in a sealing layer to the wall after the fitting has been built in, as a base for a subsequent tiling and which seals the edge of the opening pierced in the wall for the buried part of the fitting.

This construction has the advantage that the sealing layer is applied over the sealing element in the vicinity of the penetration opening for the fitting at the fitting-side seal so that in this region no moisture can penetrate from the exterior behind the sealing layer. Because of the collar-like configuration of the sealing part, simple manipulation and simple mounting of the plaster protective cover is ensured in an advantageous manner.

According to one embodiment of the invention, the collar-like sealing element is formed as a tubular stub which externally engages the plaster protective cover. This stub can be correspondingly foreshortened in the framework of the final mounting of the fitting. Because of its massive configuration, the stub is guided by the plaster protective cover and held thereby whereby the plaster protective cover itself is releasably held on the buried part of the fitting.

In an alternative embodiment of the invention, the sealing element is formed as an elastic cover which also is pressed over the plaster protective cover and lies with an annular flange against the wall and is embedded in an identical manner in the sealing layer as is the stub-type sealing member. In this case, the plaster protective cover is foreshortened correspondingly in the final mounting of the fitting.

For sealing of the finely mounted fitting, the invention provides in an embodiment that, after the removal of foreshortening of the plaster protective cover, an elastic closure ring is inserted into the room side end of the foreshortened sealing element or the plaster protective cover which seals the sealing part or the plaster protective cover with respect to a visible escutcheon for covering and sealing the controls of the fitting.

In a preferred embodiment the invention provides a protective cover with an interior to receive the elastic closure ring as well as the elastic collar as sealing parts and is closed with a removable cover so that the fitting body can be handled in a premounted state at the building site, whereby the associated sealing parts, upon the mounting of the buried part, can be removed in a simple manner from the plaster protective cover and introduced.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
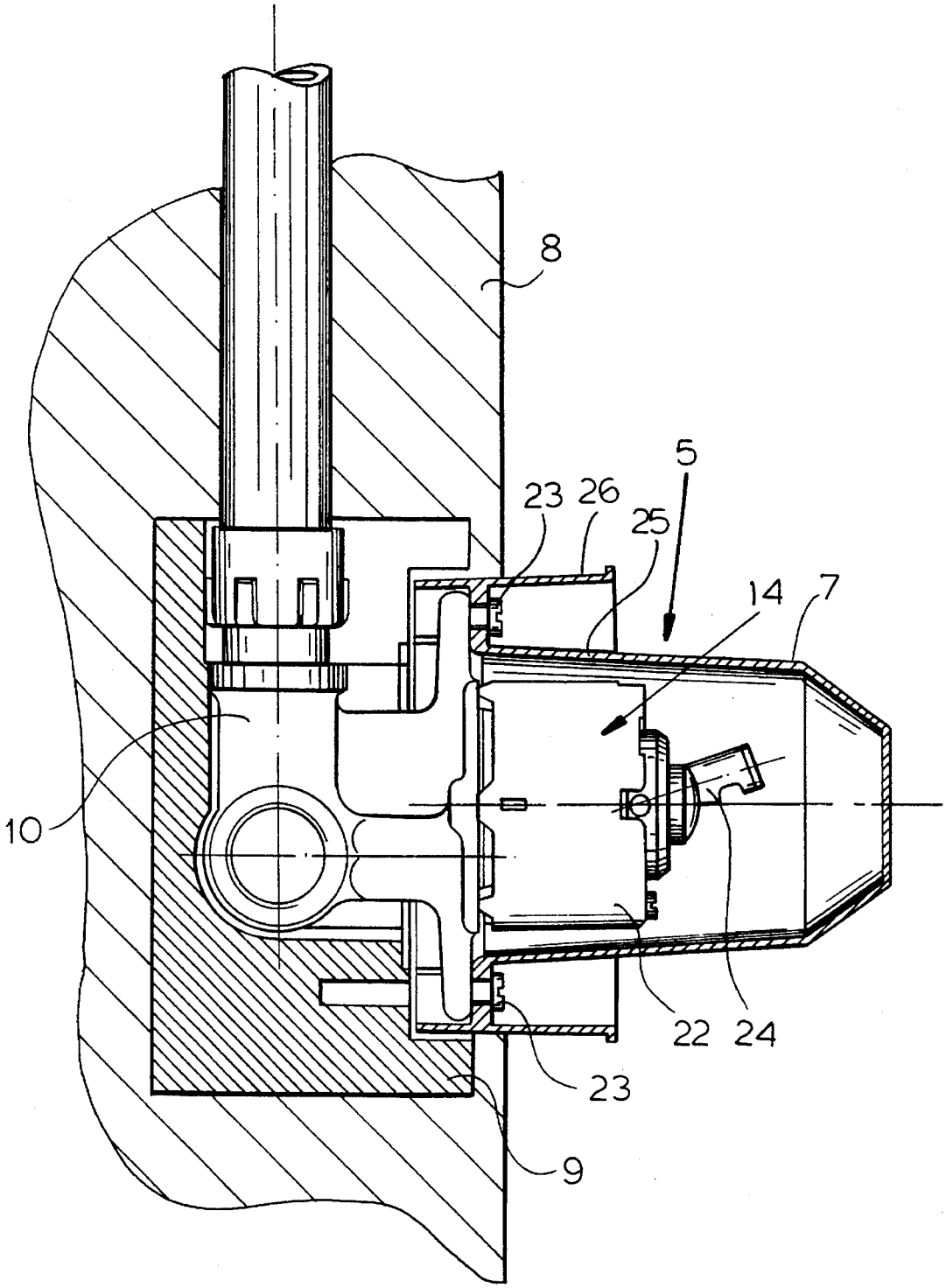
FIG. 1 is a cross sectional view of a wall with a buried body set into a wall of a wall with a fitting and plaster protective cover held thereon prior to the tiling.

The buried body 10 of a fitting is built into a wall 8 which is prepared by means of a plaster layer for the tiling. The front side of the wall 8 can be formed by a corresponding [plaster] board in drywall construction or preliminary wall installation. To protect the parts of the fitting, a plaster protective cover 5 is fastened by screws 23 on the buried body 10.

At its rear, the buried body 10 is protected by an insulating body 9 which serves for sound damping (body sound insulation) as well as thermal insulation. It further serves to inhibit the formation of condensate (sweating) in this region.

The plaster protective cover 5 projects with a hood shaped protective part [cap or dome] 7 beyond the surface of the wall 8 the hood 7 covers the functional parts of the fitting which are not visible in the final mounting of the fitting, especially the housing 14, the controls 22 and the operating lever 24. In the illustrated embodiment, the region of the plaster protective cover 5 lying against the buried body 10 is U-shaped in cross section with an inner shank 25 and an outer shank 26, whereby the screws 23 for holding the plaster protective cover are arranged at the deepest part of the U-shaped configuration between the shanks 25, 26 of the plaster protective cover in the protected position.

Figure 2:
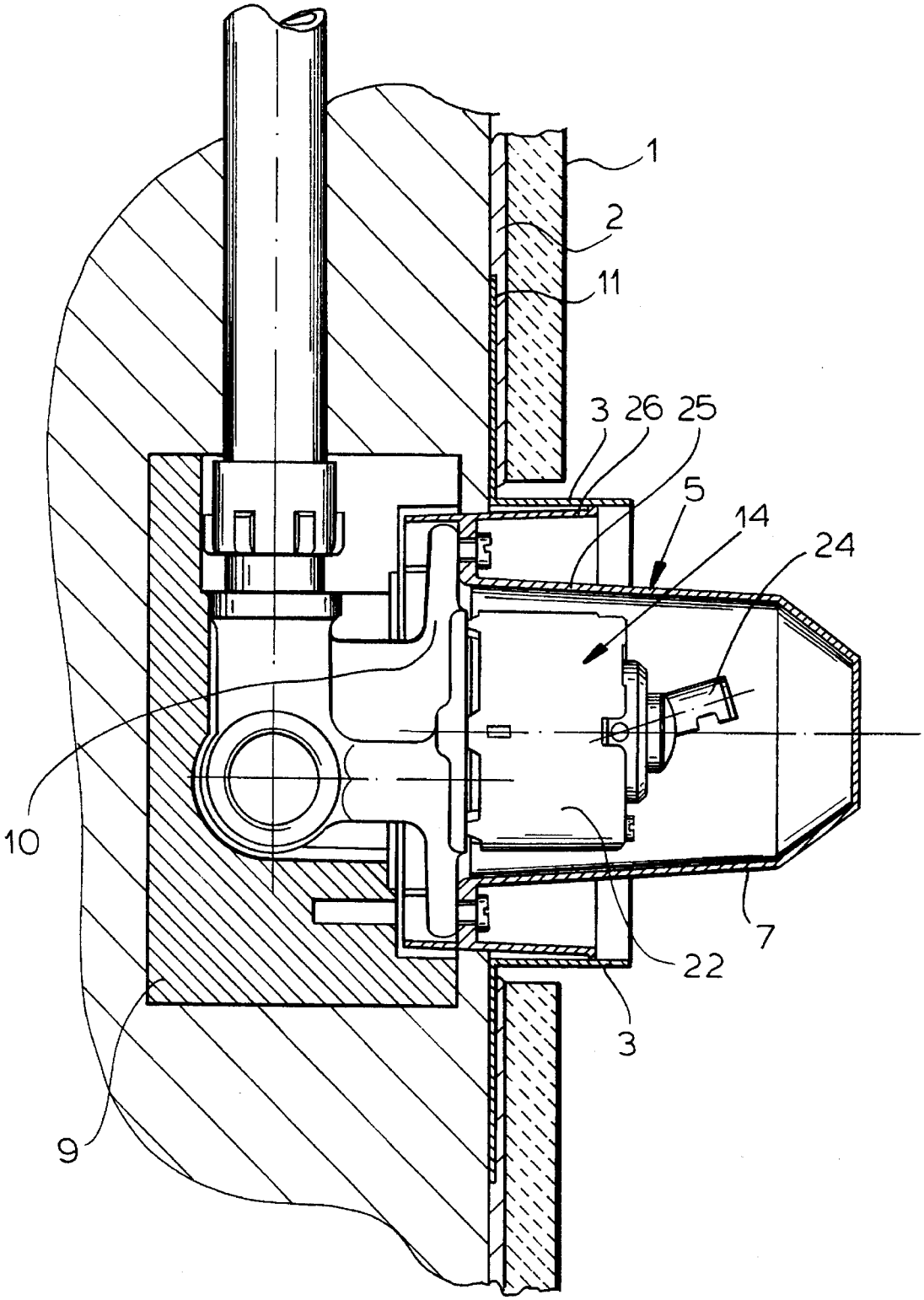
FIG. 2 is a cross sectional view similar to FIG. 1 showing the sealing elements inserted therein after the tiling of the wall.

As can be seen from FIG. 2, in preparation for tiling, a collar-like sealing part is shoved over the plaster protective cover 5 in the form of a stub 3 which surrounds the outer shank 26 of the plaster protective cover 5 projecting from the wall and has an annular flange 11 lying against the wall 8. The wall 8 is provided with a sealing layer 2 in which the annular flange 11 is embedded. The sealing layer 2 serves in turn as the base for a tiling 1.

Figure 3:
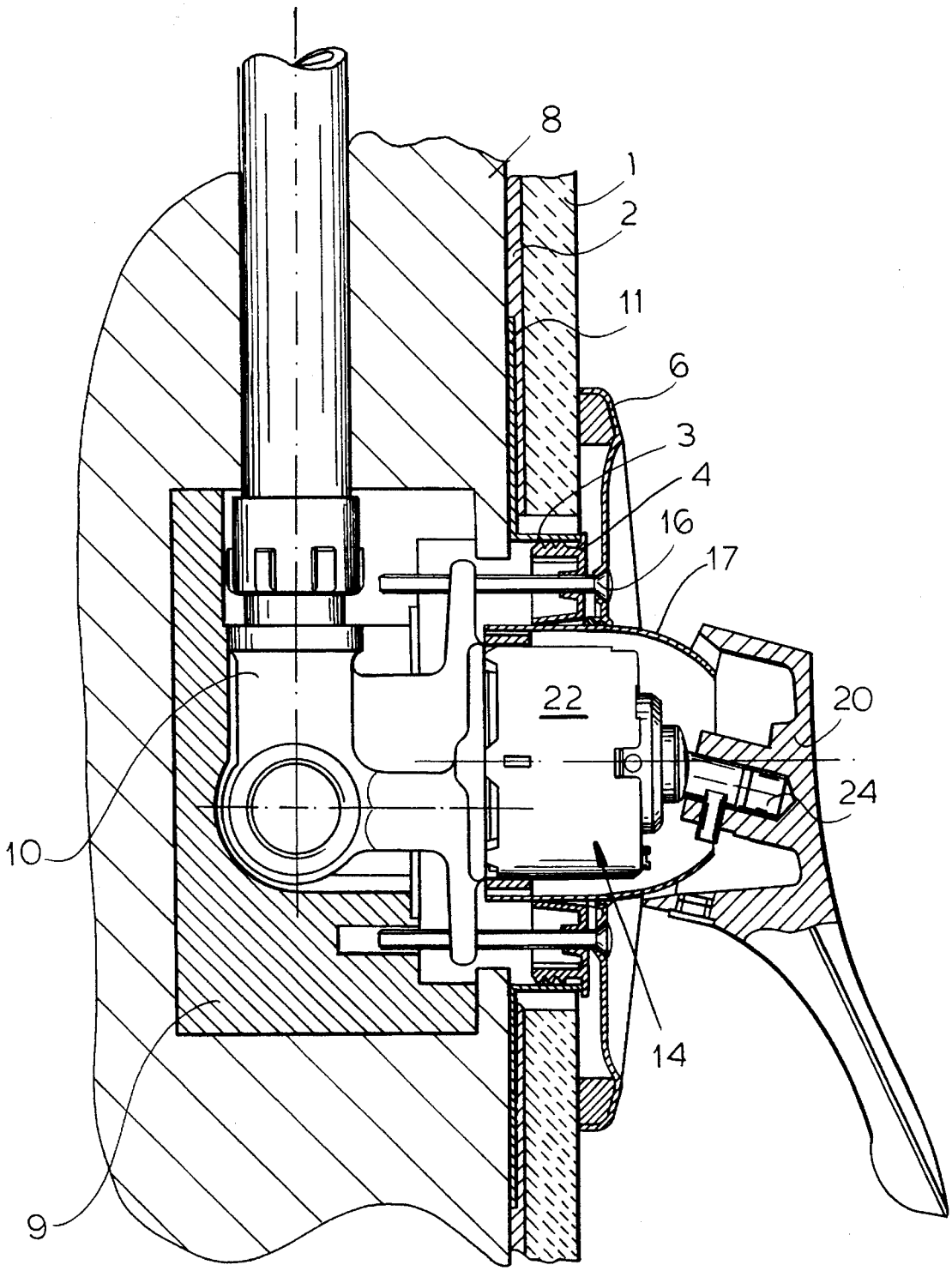
FIG. 3 is a section through the wall showing the fitting according to FIG. 1 or FIG. 2 in finished mounted state.

In FIG. 3 the condition at final mounting of the fitting is shown, starting from the condition according to FIG. 1 and as achieved by the following steps. For finished mounting initially the plaster protective cover 5 is removed by releasing screws 23 from the buried body 10, and the stub 3 is shortened, for example, by a knife to the level of the tiling 1. In the thus shortened stub 3, a closure ring 4 is inserted, fabricated from an elastomer, and then a valve cap 17 is mounted. A rosette or escutcheon 6 is then fastened by means of screws 16 on the buried body 10 and a handle lever 20 is fixed on the control lever 24 of the fitting. In the final mounted state the lip seal of the closure ring 4 seals completely against the stub 3 and against the valve cap 17 or the fitting body.

Water which might derive from the plane of the sealing layer 2, for example, because the tiling is incomplete and porous, thus finds no entry in the region where the buried body 10 projects through, into the wall 8, but rather flows away in front of the tiling 1 or in front of the sealing layer 2. Any incomplete sealing of the escutcheon 6, which is possible at the low points in the gaps in the tiling 1, also will result in no leakage into the wall because the leakage water is prevented from entering the wall 8 by the closure ring 4, the stub 3 with annular flange 11 and the valve cap 17.

Figure 4:
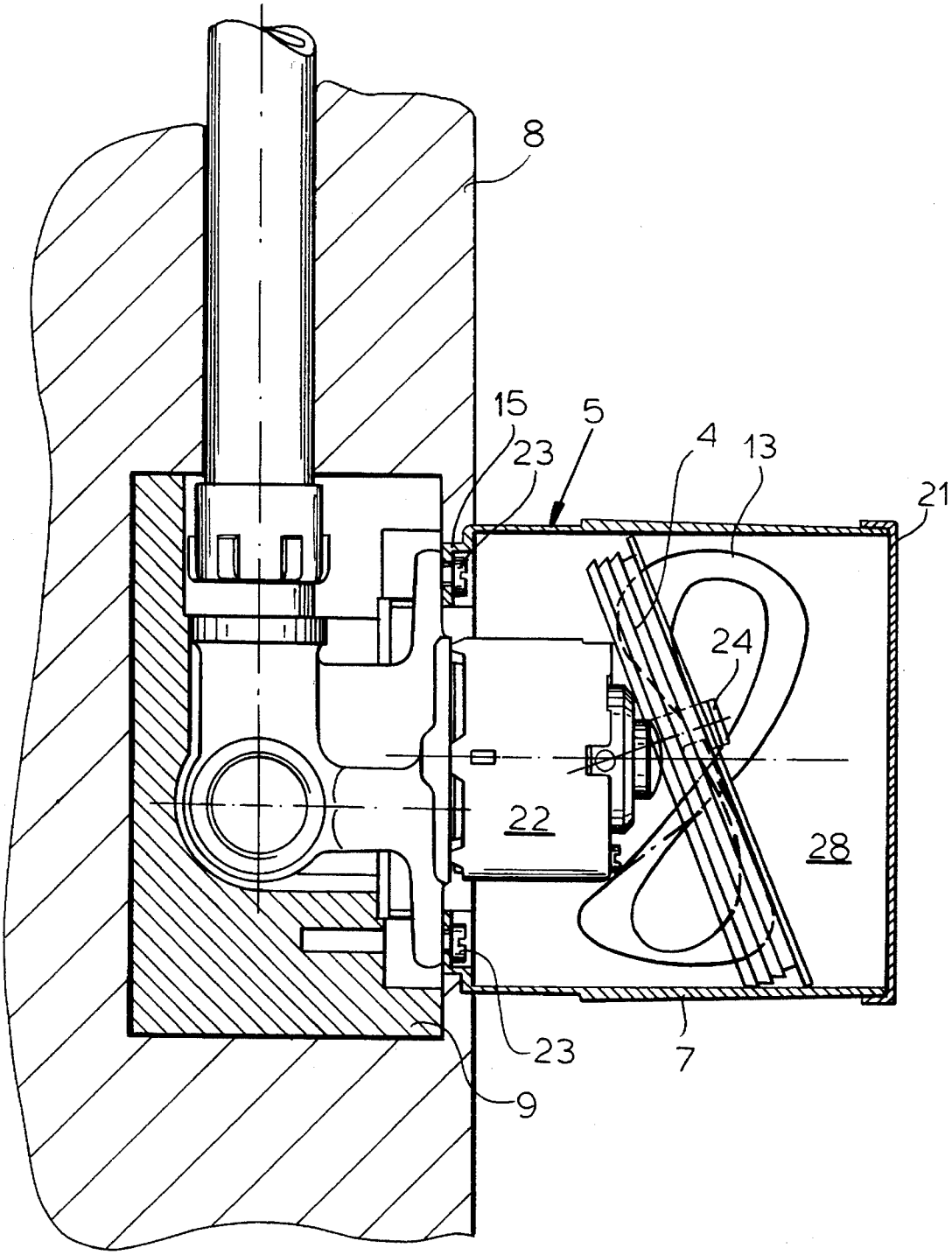
FIG. 4 is a sectional view similar to FIG. 1 of another embodiment of the invention.
Figure 5:
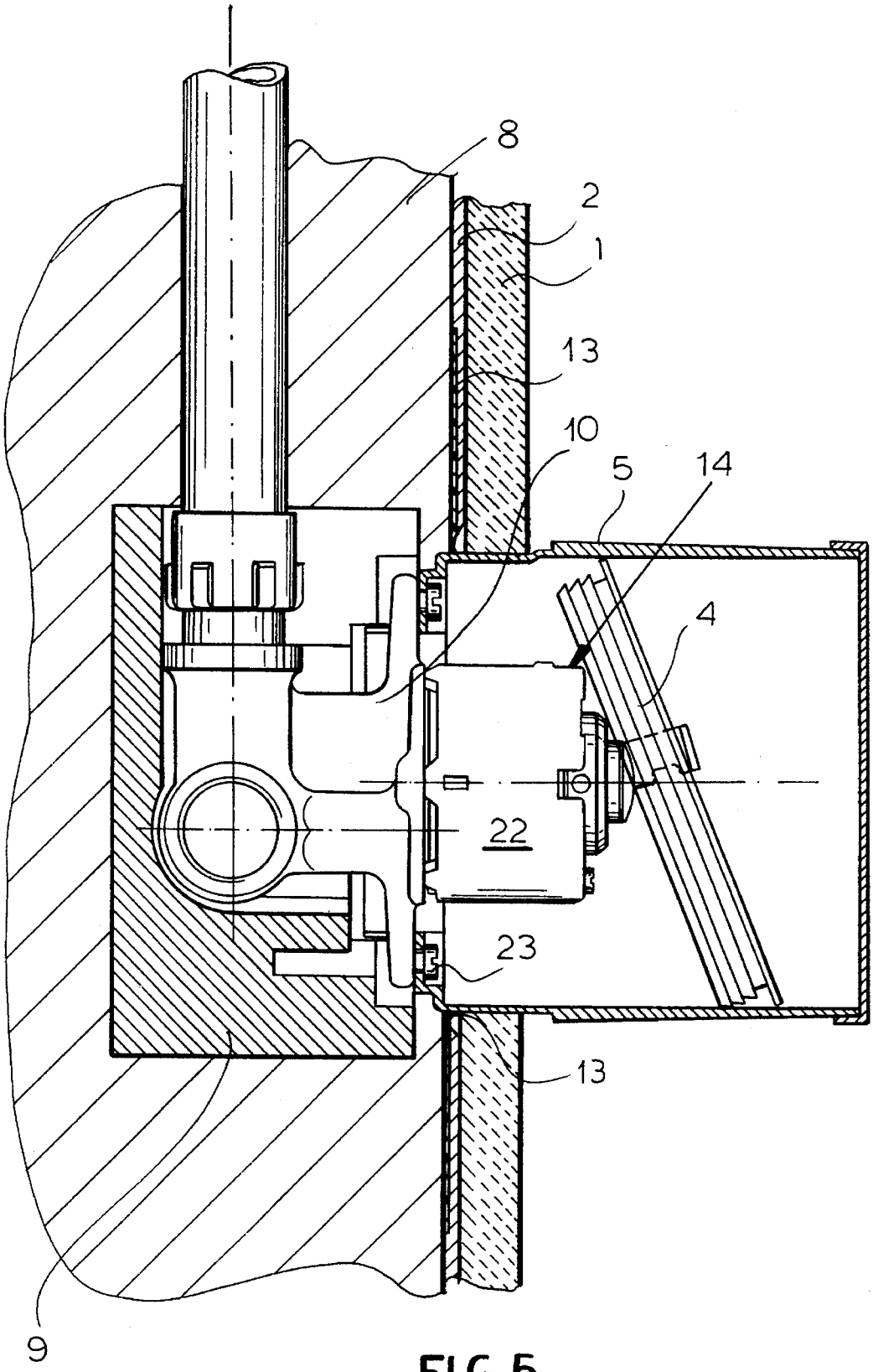
FIGS. 5 and 6 are views of the embodiment of FIG. 4 in states corresponding to FIGS. 2 and 3.
Figure 6:
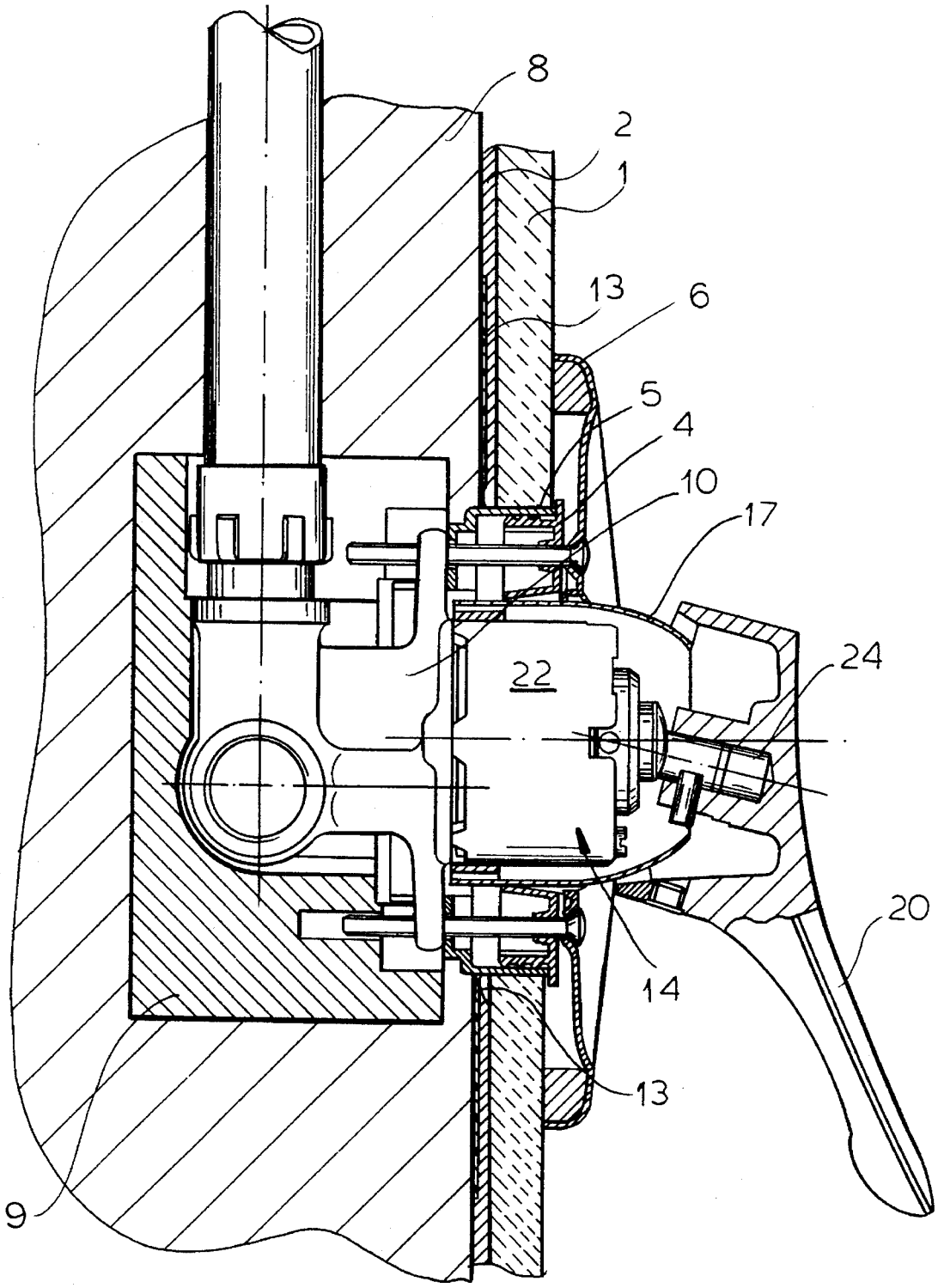

In FIGS. 4–6 another preferred embodiment of the invention is illustrated whereby the mounting states shown in FIGS. 4–6 correspond generally to the mounting states individually described previously according to FIGS. 1–3.

In the embodiment shown in FIGS. 4–6, the plaster protective cover 5 is formed substantially cylindrically and has an inner space 28 closed by means of a cover 21. The functional parts 22, 24, of the fitting to be protected by the plaster protective cover 5 are initially located in the interior 28.

Furthermore, the interior 28 provides place to receive the elastic closure ring 4 as well as the elastic sleeve 13 which serve as sealing parts to be pressed over the plaster protective cover. The elastic collar or 13 corresponds in form and function to the annular flange 11 and stub 3 described in connection with the embodiment of FIGS. 1–3.

In this embodiment, the plaster protective cover 5 remains as a stub for the collar 13 on the fitting body and during the final mounting is shortened. The advantage of this embodiment is that in the manipulation of the assembly to build the buried body in the wall no separate parts need be supplied because all required sealing parts are contained within the plaster protective cover secured to the buried body.

The features disclosed in the foregoing description, the patent claims, the abstract and the drawing of the features of this application can also be individually or in optional combinations important to the effectiveness of the invention in its advantageous embodiments.

I claim:

1. A cover and fitting wall assembly comprising:

a fitting having a body buried into an opening in a wall;

a plaster protective cover fastened on the buried body of the fitting for building into the wall and for protecting internal fitting parts, said cover having a protective hood; and a water tight circumferential sealing collar extending outwardly and lying against the wall, the sealing collar having an annular flange embedded in a sealing layer applied to the wall after the buried body has been built in, as any base for a subsequently applied tiling and sealing the edge of an opening in the wall accommodating the buried body of the fitting.

2. The cover and fitting wall assembly defined in claim 1 wherein the sealing collar has a stub fitting over and engaging an exterior of the plaster protective cover.

3. The cover and fitting wall assembly defined in claim 2 wherein the plaster protective cover forms a guide for the stub and is releasably connected to the buried body of the fitting.

4. The cover and fitting wall assembly defined in claim 1 wherein the sealing collar is an elastic collar fitted over an exterior of the plaster protective cover.

5. The cover and fitting wall assembly defined in claim 4 further comprising an escutcheon fitted over said cover, and wherein an elastic closure ring is received in said cover and seals a portion of the fitting with respect to the escutcheon.

6. The cover and fitting wall assembly defined in claim 5 wherein the plaster protective cover has an interior for receiving the closure ring as well as the elastic collar and is closed by a removable cover.

* * * * *